United States Patent [19]

Shimomura et al.

[11] Patent Number: 4,877,003

[45] Date of Patent: Oct. 31, 1989

[54] RPM CONTROL DEVICE FOR INTERNAL COMBUSTION ENGINE

[75] Inventors: Setsuhiro Shimomura; Yukinobu Nishimura, both of Hyogo, Japan

[73] Assignee: Mitsubishi Denki Kabushiki Kaisha, Tokyo, Japan

[21] Appl. No.: 124,520

[22] Filed: Nov. 24, 1987

[30] Foreign Application Priority Data

Nov. 24, 1986 [JP] Japan ..... 61-280420

[51] Int. Cl.[4] ..... F02D 41/16; F02D 41/18

[52] U.S. Cl. ..... 123/339; 123/340; 123/341; 123/352

[58] Field of Search ..... 123/339, 340, 341, 352, 123/585, 587

[56] References Cited

U.S. PATENT DOCUMENTS

| | | | |
|---|---|---|---|
| 4,611,560 | 9/1986 | Miyazaki et al. | 123/339 |
| 4,667,632 | 5/1987 | Shimomura et al. | 123/339 |
| 4,691,675 | 9/1987 | Iwaki | 123/339 |
| 4,705,001 | 11/1987 | Danno et al. | 123/339 X |
| 4,709,674 | 12/1987 | Bianchi et al. | 123/339 |
| 4,716,871 | 1/1988 | Sakamoto et al. | 123/339 |

FOREIGN PATENT DOCUMENTS 162340 9/1984 Japan .

*Primary Examiner*—Willis R. Wolfe

*Attorney, Agent, or Firm*—Sughrue, Mion, Zinn, Macpeak & Seas

[57] ABSTRACT

In an rpm control device for an internal combustion engine, a loop for adjusting a suction rate of the engine to a target value and a loop for adjusting a speed (rpm) of the engine to a target value are operated in combination, so that the suction rate and the engine speed are adjusted quickly.

10 Claims, 1 Drawing Sheet

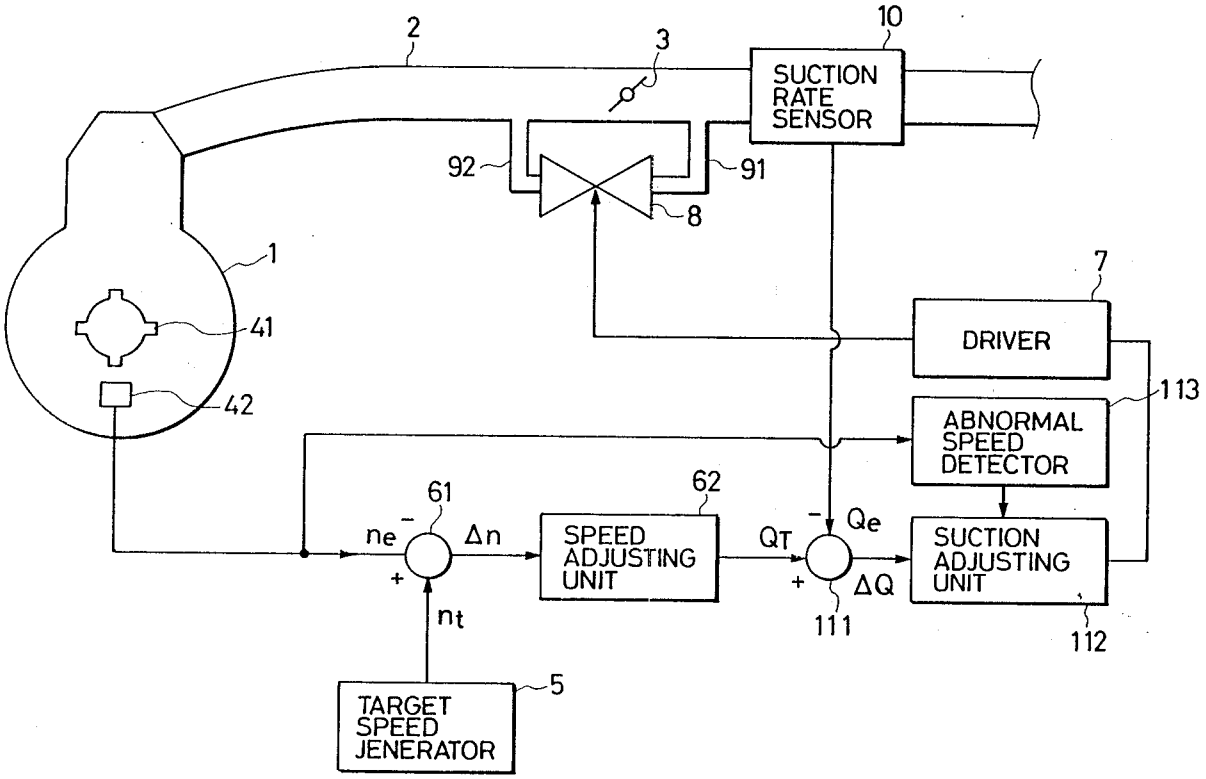
SUCTION RATE SENSOR
10
DRIVER
7
ABNORMAL SPEED DETECTOR
113
SUCTION ADJUSTING UNIT
112
91
8
3
92
2
Qe
ΔQ
111
QT
62
SPEED ADJUSTING UNIT
Δn
61
ne
nt
5
TARGET SPEED JENERATOR
1
41
42

RPM CONTROL DEVICE FOR INTERNAL COMBUSTION ENGINE

BACKGROUND OF THE INVENTION

This invention relates to an rpm control device for an internal combustion engine.

Heretofore, a method of controlling the no-load speed (rpm) of an internal combustion engine to a predetermined value is employed in the art. The purpose of this control is to set the no-load (rpm) speed to a low value thereby to reduce the fuel consumption in the no-load operation as much as possible, and to suppress the variation of the engine speed due to disturbance. Therefore, the control should be high both in response and in accuracy.

Roughly stating, the factors which affect the engine speed (revolution per minute (rpm)) can be classified into a primary group in which the engine speed (rpm) in affected by the variation in no-load loss of the engine itself or by the variation in thermal efficiency of the engine, and a secondary group in which the engine speed is affected by the variation in adjustment gain of suction adjusting means which is used to adjust the engine speed variation caused by the factors of the primary group or it is affected by the variation in density of the air sucked into the engine.

In this connection, Japanese Patent Application (OPI) No. 162340/1984 has disclosed a method in which the suction adjusting means is controlled according to an adjusting signal formed according to the difference between an actual engine speed (rpm) and a target engine speed (rpm), or an adjusting signal outputted according to the difference between an actual suction rate or pressure in the suction pipe and its target value, thereby to cause the engine speed (rpm) to reach the target value. In the method, the adjusting signal (namely, a speed (rpm) adjusting signal) based on the difference between an actual engine speed and a target engine speed is used in the case where the engine speed is affected by the factors of the primary group, and the other adjusting signal (namely, a suction adjusting signal) based on the value which is obtained by integrating the difference between an actual suction rate or pressure in the suction pipe and its target value is used in the case where the engine speed is affected by the factors of the secondary group. Therefore, it goes without saying that the method can adjust the engine speed variation accurately and quickly when compared with a method in which the engine speed only is utilized for the feedback control.

In the above-described conventional method, a suction rate adjusting loop is formed to self-correct an error inherent in its speed control means, and it should be much higher in response than the speed adjusting loop. However, the high response of the suction rate adjusting loop results in the following difficulties: That is, when the engine speed is abnormally decreased because of some disturbance, the suction rate of the engine is quickly decreased, and accordingly the suction rate adjusting signal is quickly increased. When the engine speed is abnormally low, the suction rate depends on the engine speed. Therefore, even if the suction rate adjusting signal is increased, it is impossible to increase the suction rate. As a result, while the suction rate adjusting signal is being increased, the engine is finally stopped.

When, with the engine started again, the speed adjusting loop and the suction rate adjusting loop are activated, the suction rate adjusting signal has been increased to an excessively large value. As a result, the suction rate is excessively large and accordingly the engine speed is abnormally increased. Thereafter, the engine speed is settled at a normal value.

SUMMARY OF THE INVENTION

Accordingly, an object of this invention is to eliminate the above-described difficulties accompanying a conventional engine speed control method.

More specifically, an object of the invention is to provide an rpm control device for an internal combustion engine which can achieve the adjustment of an engine speed (rpm) quickly, and can prevent the engine speed (rpm) from being abnormally changed when the engine is started again after the engine speed (rpm) has been abnormally decreased.

The foregoing object and other objects of the invention has been achieved by the provision of a speed control device for an internal combustion engine which, according to the invention, comprises: speed adjusting means for providing a target suction rate of the engine according to a speed of the engine and a target speed of the same; a suction rate sensor arranged in a suction path of the engine, to provide an electrical output corresponding to a suction rate of the engine; suction adjusting means for providing an adjusting signal according to a value which is obtained by integrating the difference between the output of the suction rate sensor and the target suction rate; a control valve for changing a suction rate of the engine substantially in proportion to the adjusting signal; and abnormal speed detecting means for resetting the value obtained through integration to a reference value when the speed of the engine is abnormally decreased.

The nature, principle and utility of the invention will become more apparent from the following detailed description when read in conjunction with the accompanying drawing.

BRIEF DESCRIPTION OF THE ACCOMPANYING DRAWING

The single figure in the accompanying drawing is an explanatory diagram, partly as a block diagram, showing one example of an rpm control device for an internal combustion engine according to this invention.

DETAILED DESCRIPTION OF THE PREFERRED EMBODIMENT

One example of an rpm control device for an internal combustion engine according to the invention will be described with reference to the single figure of the accompanying drawing.

In the figure, reference numeral 1 designates an internal combustion engine, to which a suction pipe 2 is connected. A throttle valve 3 is provided in the suction pipe 2 at a predetermined position. The valve 3 is used to control the number of revolution per minute according to a load given to the engine. Bypass pipes (passageways) 91 and 92 are connected to the suction pipe 2 on both sides of the throttle valve 3. The bypass pipes 91 and 92 are connected together through a solenoid valve 8 having a linear characteristic. The solenoid valve 8 is driven by the output of a drive unit 7.

On the other hand, a gear 41 is coupled to the internal combustion engine 1. The gear 41 is operated in association with the rotation of the engine 1. The rotation of the gear 41 is detected by a revolution sensor 42. That is, the revolution sensor 42 detects the rotation of the gear 41 to apply the speed (rpm) $n_e$ of the engine to an error amplifier 61.

The output $n_t$ of a target speed generator 5 is also applied to the error amplifier 61. The error amplifier 61 calculates the error $\Delta n$ between the output $n_e$ of the revolution sensor 42 and the output $n_t$ of the target speed generator 5 and applied it to a speed adjusting unit 62. The target speed generator 5 is to provide a target value, namely, a target no-load speed according to various conditions such as for instance engine temperature. The speed adjusting unit 62 receives the output of the error amplifier 61 to output a speed adjusting signal so that the error $\Delta n$ is eliminated by proportion, integration or differentiation.

The output of the speed adjusting unit 62 is the target suction rate QT of the engine, which is supplied to an error amplifier 111 to which a suction rate $Q_e$ outputted by a suction rate sensor 10 is applied.

The suction rate sensor 10 is high in response and is connected to the suction pipe. The error amplifier 111 calculates the error $\Delta Q$ between the target suction rate QT provided by the speed adjusting unit 62 and the suction rate $Q_e$ outputted by the suction rate sensor 10 and applies it to a suction adjusting unit 112.

Upon reception of the error $\Delta Q$, the suction adjusting unit 112 outputs a suction adjusting signal so that the error $\Delta Q$ is eliminated by integration. The signal is supplied to the drive unit 7.

The drive unit 7 applies a drive signal to the solenoid valve 8 to control the opening area of the latter 8.

On the other hand, the output of the revolution sensor 42 is further applied to an abnormal speed (rpm) detector 113 which is coupled to the suction adjusting unit 112.

The operation of the internal combustion engine's speed control device thus organized will be described.

The speed adjusting unit 62 operates according to the error $\Delta n$ applied thereto, to provide an output. As was described above, the speed adjusting unit 62 operates to provide the target suction rate of the engine 1 in association with a speed of the engine and the target speed of the same. The speed adjusting unit 62 provides its output to reduce the error $\Delta n$ outputted by the error amplifier 61, and therefore the output is settled when the error $\Delta n$ is minimized.

As was described above, the output of the unit 62 is employed as the target suction rate QT of the engine 1 and supplied to the error amplifier 111, to which the output $Q_e$ of the suction rate sensor 10.

In the amplifier 111, the error $\Delta Q$ between the output $Q_e$ and the target suction rate QT is obtained. The error $\Delta Q$ is applied to the suction adjusting unit 112. The unit 112 operates according to the error $\Delta Q$, to provide an output. This output is a signal on the value obtained by integrating the difference between the suction rate $Q_e$ outputted by the suction rate sensor 10 and the target suction rate QT.

The suction adjusting unit 112 provides its output so as to decrease the error $\Delta Q$, and therefore the output is settled when the error $\Delta Q$ is minimized. The output of the suction adjusting unit 112 is converted into an electrical signal by the drive unit 7.

The electrical signal is supplied to the linear solenoid valve 8. The solenoid valve 8 and the suction rate sensor 10 excellent in response form suction rate adjusting loop. The integration gain of the suction rate adjusting loop is set to 10 to 100 times that of a speed adjusting loop which essentially comprises the speed adjusting unit 62. This setting is based on the results of the experiments. And it has been determined that the integration gain of the suction rate adjusting loop should be 10 to 100 times that of the speed adjusting loop, because for the purpose of suitably controlling the suction rate of the engine the integration gain of the suction rate adjusting loop should be at least 10 times that of he speed adjusting loop, and if the integration gain is excessively large, then the suction rate adjusting loop itself suffers from hunting.

In response to the electrical signal from the drive unit 7, the solenoid valve 8 opens to the opening area corresponding to the electrical signal; that is, the valve position changes with the input voltage.

When the solenoid valve 8 opens in response to the electrical signal, the air sucked into the suction pipe 2 flows through the bypass pipes 91 and 92 so that the suction rate of the engine 1 changes.

As a result, the speed (rpm) of the internal combustion engine is settled at the target value, while the suction rate is also settled at the target value. In this case, the error $\Delta Q$ has been minimized by the suction adjusting signal. This is because the suction adjusting signal adjusts the errors which are inherent in the suction rate adjusting components and attribute to the fluctuation in quantity of leakage air with the throttle valve at the no-load position, the initial characteristic error or the characteristic variation with temperature of the solenoid valve 8, the dependability of the drive unit 7 on the supply voltage, and the dependability of the gain on the air density.

Next, the speed adjusting signal minimizes the error $\Delta n$ thereby to adjust the target suction rate QT so that the engine speed $n_e$ coincides substantially with the target speed nT. That is, the speed adjusting signal adjusts the fluctuations in loss of the various parts of the engine, the variation of thermal efficiency with temperature, or the load variations of various components such as lamps and motors for instance in a vehicle's internal combustion engine.

In the above-described operation of the rpm control device, the engine speed is free from extremely large disturbance.

Now, the operation of the rpm control device in which the engine speed is greatly decreased because of excessively large disturbance.

At the engine speed is greatly decreased, the suction power of the engine is also decreased, so that the negative pressure for suction, downstream of the throttle valve 3, is decreased, and finally the pressures before and after the throttle valve 3 become substantially equal to each other. As a result, even if the solenoid value 8 is driven to increase its opening area, the suction rate is not increased; that is, it is impossible to restore the engine speed.

It is obvious that, under this condition, the suction rate adjusting value is increased to cause the suction rate to reach the target value, but he engine will be stopped. In this case, the abnormal speed detector 113 detects the abnormal speed decreased, and applies a reset signal to the suction adjusting unit 112. As a result, the integration value of the adjusting signal of the suction adjusting unit 112 is reset to the reference value.

Accordingly, when the engine is started again, the suction adjusting signal has a suitable value (or the reference value), and therefore the solenoid valve 8 shows a suitable opening degree (i.e., the suction rate is suitable), and the engine speed (rpm) will not abnormally increased.

In the above-described rpm control device, the solenoid valve 8 is used. However, the same effect can be obtained by employing other suction rate adjusting means such as a valve operated by a step-motor or DC motor.

A variety of suction rate sensors are available as the suction rate sensor 10. For instance, a hot wire type suction rate sensor, a vane type suction rate sensor, and a Karman's vortex type suction rate sensor can be employed. Among these suction rate sensors, the hot wire type suction rate sensor is most suitable for the invention, because it measures the mass of air.

Furthermore, in the rpm control device, the suction rate measuring means may be a pressure sensor provided in the suction pipe. In this case, it goes without saying that the pressure sensor should be disposed between the throttle valve and the engine.

As was described above, in the rpm control device of the invention, the loop for adjusting a suction rate to a target value and the loop for adjusting a speed (rpm) to a target value are operated in combination. Therefore, the adjustment can be achieved quickly, and when the engine is started again which has been stopped because of the abnormal decrease of the engine sped, the engine speed will not abnormally increased.

What is claimed is:

1. An rpm control device for an internal combustion engine comprising:

speed adjusting means for providing a target suction rate of said engine according to a speed of said engine and a target speed of said engine;

a suction rate sensor arranged in a suction path of said engine, for providing an electrical output corresponding to a suction rate of said engine;

suction adjusting means for providing an adjusting signal according to a value which is obtained by integrating the difference between an output of said suction rate sensor and said target suction rate;

control valve means for changing a suction rate of said engine substantially in proportion to said adjusting signal;

driver means for driving said control valve means according to said adjusting signal; and abnormal speed detecting means for resetting said value obtained through integration to a reference value when the speed of said engine is abnormally decreased.

2. An rpm control device as claimed in claim 1, further comprising revolution sensor for detecting the speed of said engine.

3. An rpm control device as claimed in claim 1, further comprising a target speed generator for provide said target speed.

4. An rpm control device as claimed in claim 1, in which said suction rate sensor comprises a hot wire type suction rate sensor.

5. An rpm control device as claimed in claim 1, in which said suction rate sensor comprises a vane type suction rate sensor.

6. An rpm control device as claimed in claim 1, in which said suction rate sensor comprises a Karman's vortex type suction rate sensor.

7. An rpm control device as claimed in claim 1, in which said suction rate sensor comprises a pressure sensor provided in the suction path.

8. An rpm control device as claimed in claim 1, in which said control valve means comprises a solenoid valve.

9. An rpm control device as claimed in claim 1, in which said control valve means comprises a valve operated by a step-motor.

10. An rpm control device as claimed in claim 1, in which said control valve means comprises a valve operated by a DC motor.

* * * * *